US011676545B2

(12) United States Patent
Park

(10) Patent No.: US 11,676,545 B2
(45) Date of Patent: Jun. 13, 2023

(54) DISPLAY DEVICE AND DISPLAY DRIVING METHOD

(71) Applicant: LG DISPLAY CO., LTD., Seoul (KR)

(72) Inventor: SangHyun Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/860,180

(22) Filed: Jul. 8, 2022

(65) Prior Publication Data

US 2023/0040625 A1 Feb. 9, 2023

(30) Foreign Application Priority Data

Aug. 6, 2021 (KR) ..... 10-2021-0103609

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0426* (2013.01); *G09G 2300/0452* (2013.01); *G09G 2300/0842* (2013.01); *G09G 2310/08* (2013.01); *G09G 2330/026* (2013.01); *G09G 2330/027* (2013.01)

(58) Field of Classification Search
CPC ..... G09G 3/3291; G09G 3/3233; G09G 2300/0426; G09G 2300/0452; G09G 2300/0842; G09G 2310/08; G09G 2330/026; G09G 2330/027
See application file for complete search history.

(56) References Cited

U.S. PATENT DOCUMENTS

2014/0168184 A1* 6/2014 Kim ..... G09G 3/3258 345/79
2014/0247253 A1* 9/2014 Cho ..... G09G 5/003 345/204
2017/0169757 A1* 6/2017 Kim ..... G09G 3/20
2020/0066226 A1* 2/2020 Han ..... G09G 5/006
2020/0111427 A1* 4/2020 Chen ..... G09G 5/006
2021/0225236 A1* 7/2021 Zhu ..... G09G 3/20

* cited by examiner

*Primary Examiner* — Premal R Patel
(74) *Attorney, Agent, or Firm* — Polsinelli PC

(57) ABSTRACT

A display device includes a display panel on which a plurality of sub-pixels are disposed; a timing controller configured to transmit an image control signal to a host system to receive image data from the host system; a data driving circuit configured to convert the image data transmitted from the timing controller into a data voltage and configured to supply the data voltage to the display panel; and a semi-off switching circuit configured to control the image control signal so that the image data is cut off from the host system during a semi-off period of a predetermined time from a time when an off monitoring signal is transmitted from the host system in response to the power off signal.

17 Claims, 12 Drawing Sheets

DISPLAY DEVICE AND DISPLAY DRIVING METHOD

CROSS-REFERENCE TO RELATED APPLICATION

This application claims the priority of Korean Patent Application No. 10-2021-0103609, filed on Aug. 6, 2021, which is hereby incorporated by reference in its entirety.

BACKGROUND

Field of the Disclosure

The present disclosure relates to a display device and a display driving method capable of performing quickly an on-process of a display panel when a power-on signal is supplied while an off-process is in progress.

Description of the Background

With the development of the information society, there has been an increasing demand for a variety of types of image display devices. In this regard, a range of display devices, such as liquid crystal display device, and organic light emitting display device, have recently come into widespread use.

Among such display devices, the organic light emitting display devices have superior properties, such as rapid response speeds, high contrast ratios, high emissive efficiency, high luminance, and wide viewing angles, since self-emissive organic light emitting diodes are used as a light emitting element.

Such an organic light emitting display device may include organic light emitting diodes disposed in a plurality of sub-pixels aligned in a display panel, and may control the organic light emitting diodes to emit light by controlling the current flowing through the light emitting diodes, so as to display an image while controlling luminance of the sub-pixels.

Since such a display device may transmit a power on signal or a power off signal through a remote controller as well as a power button, the on process or off-process of the display panel according to the user's intention may occur frequently.

In this case, as the size of the display device increases and the number of functions increases, the time for the on-process in response to the power on signal and the time for the off process in response to the power off signal may increase. In particular, when the power-on signal is supplied while the off process is in progress, it may take a long time to drive the display panel since the on-process will be performed again after the off-process is completed.

In particular, recently, a process for detecting and compensating for deviation of a characteristic values (threshold voltage or mobility) of driving transistors in sub-pixels of a display panel has been used. Since the compensation process is mainly performed in the off process being performed after the power off signal is generated or the in the on process being performed after the power on signal is generated, it may take more time to drive the display panel again while the off-process is in progress.

SUMMARY

Accordingly, the present disclosure is to provide a display device and a display driving method capable of reducing a time for performing the on process.

The present disclosure is also to provide a display device and a display driving method capable of performing quickly the on process of the display panel when the power on signal is supplied while the off process is in progress.

Further, the present disclosure is to provide a display device and a display driving method capable of reducing a display driving time by performing a semi-off process for a certain period of time when the power off signal is supplied, and performing a quick start process when the power on signal is supplied within the period of semi-off process.

According to an aspect of the present disclosure, a display device includes a display panel on which a plurality of sub-pixels are disposed, a timing controller configured to transmit an image control signal to a host system to receive image data from the host system, a data driving circuit configured to convert the image data transmitted from the timing controller into a data voltage and configured to supply the data voltage to the display panel, and a semi-off switching circuit configured to control the image control signal so that the image data is cut off from the host system during a semi-off period of a first predetermined time from a time when an off monitoring signal is transmitted from the host system in response to the power off signal.

According to another aspect of the present disclosure, a display driving method for controlling a display device includes a display panel on which a plurality of sub-pixels are disposed, a timing controller configured to control an operation of a host system supplying an image data by an image control signal, and a data driving circuit configured to convert the image data transmitted from the timing controller into a data voltage and supply the data voltage to the display panel, comprising, determining whether a power off signal is supplied, performing a semi-off process for blocking the image data while maintaining a driving power supplied to the data driving circuit when the power off signal is supplied, performing a quick start process when a power on signal is supplied within the semi-off period, and cutting off the driving power when the power on signal is not supplied within the semi-off period.

According to a further aspect of the present disclosure, a display device includes a display panel on which a plurality of sub-pixels are disposed; a timing controller configured to transmit an image control signal to a host system to receive image data from the host system; a data driving circuit configured to convert the image data transmitted from the timing controller into a data voltage and configured to supply the data voltage to the display panel; and a semi-off switching circuit configured to control the timing controller to perform a semi-off process for cutting off the image data while maintaining a driving power supplied to the data driving circuit during a semi-off period when an off-monitoring signal indicating a supply of a power off signal is received from the host system, and to perform a quick start process for supplying the image data when a power on signal is supplied within the semi-off period.

According to the present disclosure, it is possible to provide a display device or a display driving method capable of reducing a time for performing the on process.

According to the present disclosure, it is possible to provide a display device or a display driving method capable of performing quickly the on process of the display panel when the power on signal is supplied while the off process is in progress.

According to the present disclosure, it is possible to provide a display device or a display driving method capable of reducing a display driving time by performing a semi-off process for a certain period of time when the power off signal is supplied, and performing a quick start process when the power on signal is supplied within the period of semi-off process.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
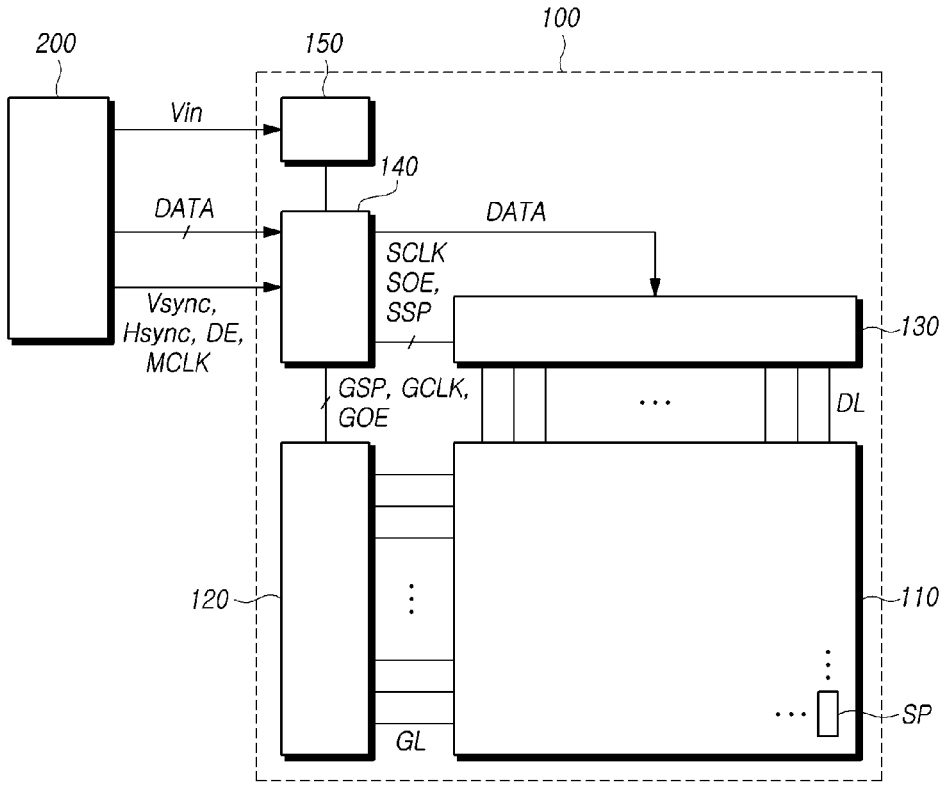
FIG. 1 illustrates a schematic diagram of a display device according to the present disclosure.

Hereinafter, some aspects of the present disclosure will be described in detail with reference to exemplary drawings. In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, various aspects of the present disclosure will be described in detail with reference to the accompanying drawings.

FIG. 1 illustrates a schematic diagram of a display device according to the present disclosure.

Referring to FIG. 1, the display device 100 according to aspects of the present disclosure may include a display panel 110 connected to a plurality of gate lines GL and a plurality of data lines DL in which a plurality of sub-pixels SP are arranged in rows and columns, a gate driving circuit 120 for supplying scan signals to the plurality of gate lines GL and a data driving circuit 130 for supplying data voltages to the plurality of data lines DL, a timing controller 140 for controlling the gate driving circuit 120 and the data driving circuit 130, and a power management circuit 150.

The display panel 110 displays an image based on the scan signals supplied from the gate driving circuit 120 through the plurality of gate lines GL and the data voltages supplied from the data driving circuit 130 through the plurality of data lines DL.

In the case of a liquid crystal display, the display panel 110 includes a liquid crystal layer formed between two substrates, and TN (Twisted Nematic) mode, VA (Vertical Alignment) mode, IPS (In Plane Switching) mode, FFS (Fringe Field Switching) mode may be operated in any known mode. In the case of an organic light emitting display device, the display panel 110 may be implemented in a top emission method, a bottom emission method, or a dual emission method.

In the display panel 110, a plurality of pixels may be disposed in a matrix form. Each pixel may be composed of sub-pixels SP of different colors, for example, a white sub-pixel, a red sub-pixel, a green sub-pixel, and a blue sub-pixel. Each sub-pixel SP may be defined by the plurality of the data lines DL and the plurality of the gate lines GL.

A sub-pixel SP may include a thin film transistor (TFT) arranged in a region where a data line DL and a gate line GL intersect, a light emitting element such as an light emitting diode which is emitted according to the data voltage, and a storage capacitor for maintaining the data voltage by being electrically connected to the light emitting element.

For example, when the display device 100 having a resolution of 2,160×3,840 includes four sub-pixels SP of white W, red R, green G, and blue B, 3,840×4=15,360 data lines DL may be provided by 2,160 gate lines GL and 3,840 data lines DL respectively connected to 4 sub-pixels WRGB. Each of the plurality of sub-pixels SP may be disposed in areas in which the plurality of gate lines GL overlap the plurality of data lines DL.

The gate driving circuit 120 is controlled by the timing controller 140, and controls the driving timing of the plurality of sub-pixels SP by sequentially supplying the scan signals to the plurality of gate lines GL disposed in the display panel 110.

In the display device 100 having a resolution of 2,160×3,840, an operation of sequentially supplying the scan signals to the 2,160 gate lines GL from the first gate line GL1 to the 2,160th gate line GL2160 may be referred to as 2,160-phase driving operation. Otherwise, an operation of sequentially supplying the scan signals to every four gate lines GL, as in a case in which the scan signals are supplied sequentially from first gate line GL1 to fourth gate lines GL4, and then are supplied sequentially from fifth gate line GL5 to eighth gate line GL8, may be referred to as 4-phase driving operation. As described above, an operation in which the scan signals are supplied sequentially to every N number of gate lines may be referred as N-phase driving operation.

The gate driving circuit 120 may include one or more gate driving integrated circuits (GDIC), which may be disposed on one side or both sides of the display panel 110 depending on the driving method. Alternatively, the gate driving circuit 120 may be implemented in a gate-in-panel (GIP) structure embedded in a bezel area of the display panel 110.

The data driving circuit 130 receives digital image data DATA from the timing controller 140, and converts the received digital image data DATA into an analog data voltage. Then, the data driving circuit 130 supplies the analog data voltage to each of the data lines DL at time which the scan signal is supplied through the gate line GL, so that each of the sub-pixels SP connected to the data lines DL emits light with a corresponding luminance in response to the analog data voltage.

Likewise, the data driving circuit 130 may include one or more source driving integrated circuits (SDIC). Each of the source driving integrated circuits SDIC may be connected to a bonding pad of the display panel 110 by a tape automated bonding (TAB) or a chip on glass (COG), or may be directly mounted on the display panel 110.

In some cases, each of the source driving integrated circuits (SDIC) may be integrated with the display panel 110. In addition, each of the source driving integrated circuits (SDIC) may be implemented with a chip on film (COF) structure. In this case, the source driving integrated circuit SDIC may be mounted on circuit film to be electrically connected to the data lines DL in the display panel 110 via the circuit film.

The timing controller 140 supplies various control signals to the gate driving circuit 120 and the data driving circuit 130, and controls the operations of the gate driving circuit 120 and the data driving circuit 130. That is, the timing controller 140 controls the gate driving circuit 120 to supply the scan signals in response to a time realized by respective frames, and on the other hand, transmits the image data DATA from an external source to the data driving circuit 130.

Here, the timing controller 140 receives various timing signals, including a vertical synchronization signal Vsync, a horizontal synchronization signal Hsync, a data enable signal DE, and a main clock MCLK, from an external host system 200.

The host system 200 may be any one of a TV (Television) system, a set-top box, a navigation system, a personal computer (PC), a home theater system, a mobile device, and a wearable device.

Accordingly, the timing controller 140 generates control signals using the various timing signals received from the external source, and supplies the control signals to the gate driving circuit 120 and the data driving circuit 130.

For example, the timing controller 140 generates various gate control signals, including a gate start pulse GSP, a gate clock GCLK, and a gate output enable signal GOE, to control the gate driving circuit 120. Here, the gate start pulse GSP is used to control the start timing of one or more gate driving integrated circuits GDIC of the gate driving circuit 120. In addition, the gate clock GCLK is a clock signal commonly supplied to the one or more gate driving integrated circuits GDIC for controlling the shift timing of the scan signals. The gate output enable signal GOE designates timing information of the one or more gate driving integrated circuits GDIC.

In addition, the timing controller 140 generates various data control signals, including a source start pulse SSP, a source sampling clock SSC, and a source output enable signal SOE, to control the data driving circuit 130. Here, the source start pulse SSP is used to control the start timing for the data sampling of one or more source driving integrated circuits SDIC of the data driving circuit 130. The source sampling clock SSC is a clock signal for controlling a timing of data sampling in each of the source driving integrated circuits SDIC. The source output enable signal SOE controls the output timing of the data driving circuit 130.

The display device 100 may further include a power management circuit 150 for supplying or controlling various voltage or current to the display panel 110, the gate driving circuit 120, and the data driving circuit 130.

The power management circuit 150 generates a necessary power to drive the display panel 100, the gate driving circuit 120, and the data driving circuit 130 by controlling a DC input voltage Vin supplied from the host system 200.

The sub-pixel SP is positioned at a point where the gate line GL and the data line DL intersect and a light emitting element may be disposed in each of the sub-pixels SP. For example, the organic light emitting display device may include a light emitting element, such as a light emitting diode in each of the sub-pixels SP, and may display an image by controlling current flowing through the light emitting elements in response to the data voltage.

The display device 100 may be various types of devices such as a liquid crystal display, an organic light emitting display, and a plasma display panel.

Figure 2:
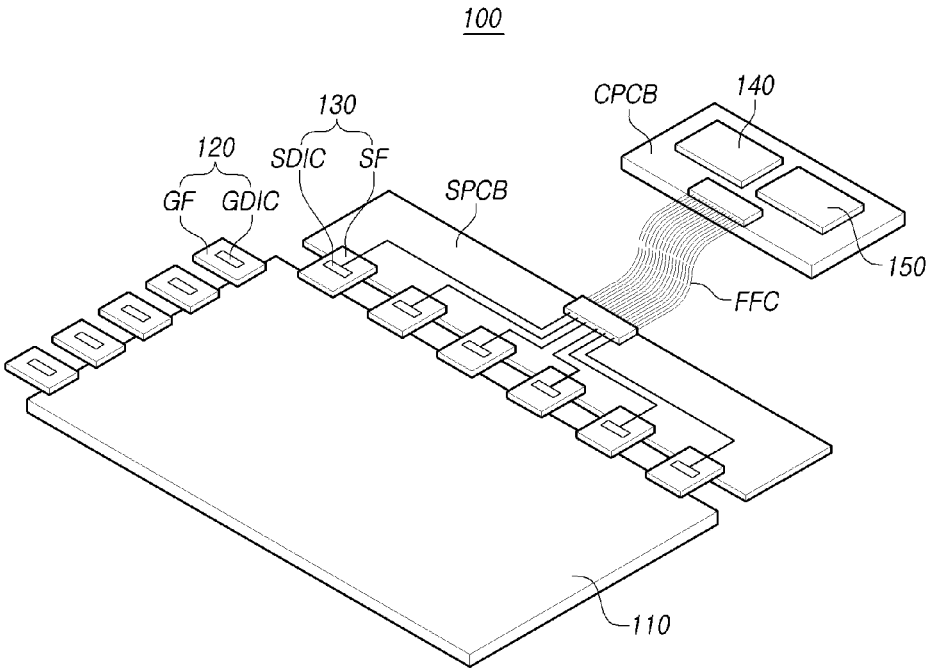
FIG. 2 illustrates a system diagram of the display device according to the present disclosure.

FIG. 2 illustrates a system diagram of the display device according to the present disclosure.

As an example, FIG. 2 illustrates that each of the source driving integrated circuits SDIC of the data driving circuit 130 and each of the gate driving integrated circuits GDIC of the gate driving circuit 120 in the display device 100 according to aspects of the present disclosure are implemented with a COF type among various structures such as a TAB, a COG, and a COF.

One or more gate driving integrated circuits GDIC included in the gate driving circuit 120 may be respectively mounted on the gate film GF, and one side of the gate film GF may be electrically connected to the display panel 110. Also, electrical lines may be disposed on the gate film GF to electrically connect the gate driving integrated circuit GDIC and the display panel 110.

Likewise, the data driving circuit 130 may include one or more source driving integrated circuits SDIC, which may be mounted on a source film SF, respectively. One portion of the source film SF may be electrically connected to the display panel 110. In addition, electrical lines may be disposed on the source films SF to electrically connect the source driving integrated circuits SDIC and the display panel 110.

The display device 100 may include at least one source printed circuit board SPCB in order to connect the plurality of source driving integrated circuits SDIC to other devices by electrical circuit, and a control printed circuit board CPCB in order to mount various control components and electric elements.

The other portion of the source film SF, on which the source driving integrated circuit SDIC is mounted, may be connected to the at least one source printed circuit board SPCB. That is, one portion of source film SF on which the source driving integrated circuit SDIC is mounted may be electrically connected to the display panel 110, and the other portion of the source film SF may be electrically connected to the source printed circuit board SPCB.

The timing controller 140 and a power management circuit 150 may be mounted on the control printed circuit board CPCB. The timing controller 140 may control the operations of the data driving circuit 130 and the gate driving circuit 120. The power management integrated circuit 150 may supply a driving voltage and a driving current, or control a voltage and a current for the data driving circuit 130 and the gate driving circuit 120.

At least one source printed circuit board SPCB and the control printed circuit board CPCB may have circuitry connection by at least one connecting member. The connecting member may be, for example, a flexible printed circuit FPC, a flexible flat cable FFC, or the like. In this case, the connecting member to connecting at least one source printed circuit board SPCB and the control printed circuit board CPCB may be variously changed according to the size and type of the display device 100. At least one source printed circuit board SPCB and the control printed circuit board CPCB may be integrated into a single printed circuit board.

In the display device 100 having the above described configuration, the power management circuit 150 supplies the driving voltage, which is required for a display driving operation or a sensing operation of the characteristic value, to the source printed circuit board SPCB through the flexible printed circuit FPC or the flexible flat cable FFC. The driving voltage supplied to the source printed circuit board SPCB, is transmitted to emit or sense a specific sub-pixel SP in the display panel 110 via the source driving integrated circuits SDIC.

Each of the sub-pixels SP arranged in the display panel 110 of the display device 100 may include an organic light emitting diode as a light emitting element and circuit elements, such as a driving transistor to drive it.

The type and number of the circuit elements constituting each of the sub-pixels SP may be variously determined depending on the function, the design, or the like.

Figure 3:
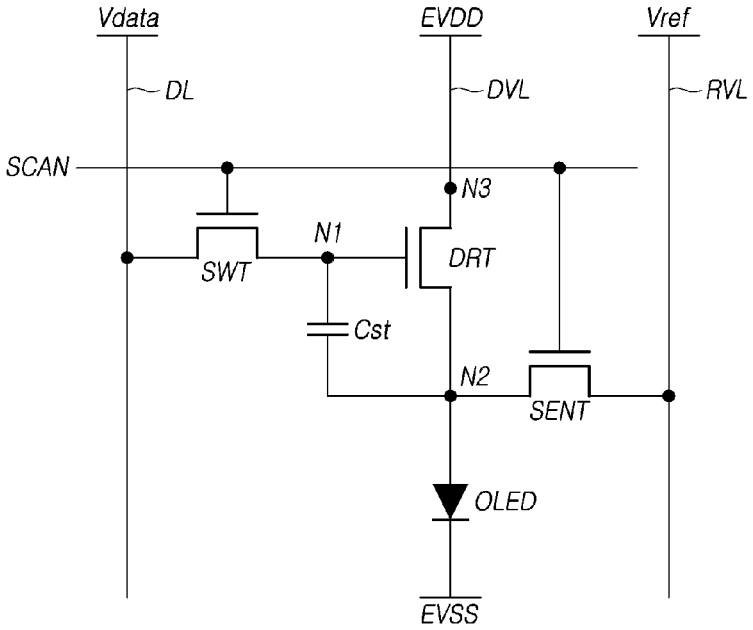
FIG. 3 illustrates a circuit diagram of a sub-pixel in the display device according to the present disclosure.

FIG. 3 illustrates a circuit diagram of a sub-pixel in the display device according to the present disclosure.

Referring to FIG. 3, each of the sub-pixels SP arranged in the display device 100 according to aspects of the present disclosure may include one or more transistors, a capacitor, and an organic light emitting diode OLED as a light emitting element.

For example, a sub-pixel SP may include a driving transistor DRT, a switching transistor SWT, a sensing transistor SENT, a storage capacitor Cst, and an organic light emitting diode OLED.

The driving transistor DRT may have a first node N1, a second node N2, and a third node N3. The first node N1 of the driving transistor DRT may be a gate node to be supplied a data voltage Vdata through a data line DL when the switching transistor SWT is turned on. The second node N2 of the driving transistor DRT may be electrically connected to an anode electrode of the light emitting element OLED, and may be a drain node or a source node. The third node N3 of the driving transistor DRT may be electrically connected to a driving voltage line DVL to be supplied a driving voltage EVDD, and may be a source node or a drain node.

Here, the driving voltage EVDD for displaying an image may be supplied to the driving voltage line DVL in the display driving period. For example, the driving voltage EVDD for displaying the image may be about 27 V.

The switching transistor SWT is electrically connected between the first node N1 of the driving transistor DRT and the data line DL, and operates in response to a scan signal SCAN supplied thereto through the gate line GL connected to the gate node. In addition, it controls the operation of the driving transistor DRT by transmitting the data voltage Vdata through the data line DL to the gate node of the driving transistor DRT when the switching transistor SWT is turned on.

The sensing transistor SENT is electrically connected between the second node N2 of the driving transistor DRT and a reference voltage line RVL, and operates in response to a sense signal SENSE supplied through the gate line GL connected to a gate node. When the sensing transistor SENT is turned on, a reference voltage Vref supplied from the reference voltage line RVL is transmitted to the second node N2 of the driving transistor DRT.

That is, the voltages of the first node N1 and the second node N2 of the driving transistor DRT may be controlled by controlling the switching transistor SWT and the sensing transistor SENT. Consequently, a current for emitting the organic light emitting diode OLED may be supplied.

Each gate node of the switching transistor SWT and the sensing transistor SENT may be connected to a single gate line GL or to different gate lines GL. Here, it illustrates an exemplary structure of which the switching transistor SWT and the sensing transistor SENT are connected to a different gate lines GL. In this case, the switching transistor SWT and the sensing transistor SENT are controlled independently by the scan signal SCAN and the sense signal SENSE transmitted from the different gate lines GL.

On the other hand, when the switching transistor SWT and the sensing transistor SENT are connected to single gate line GL, the switching transistor SWT and the sensing transistor SENT are controlled simultaneously by the scan signal SCAN or the sense signal SENSE transmitted from the single gate line GL, and thus the aperture ratio of the sub-pixels SP may be improved.

In addition, the transistors disposed in the sub-pixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata during a frame.

Such a storage capacitor Cst may be connected between the first node N1 and the third node N3 of the driving transistor DRT according to a type of the driving transistor DRT. The anode electrode of the organic light emitting diode OLED may be electrically connected to the second node N2 of the driving transistor DRT, and a base voltage EVSS may be supplied to a cathode electrode of the organic light emitting diode OLED.

Here, the base voltage EVSS may be the ground voltage or a voltage higher or lower than the ground voltage. In addition, the base voltage EVSS may be varied depending on the driving condition. For example, the base voltage EVSS during the display driving period may be different from the base voltage EVSS during the sensing period.

The structure of the sub-pixel SP described above for example is a 3T (Transistor) 1C (Capacitor) structure, which is only an example for explanation, and further includes one or more transistors, or in some cases, further include one or more capacitors. Alternatively, each of the plurality of sub-pixels SP may have the same structure, or some of the plurality of sub-pixels SP may have a different structure.

Figure 4:
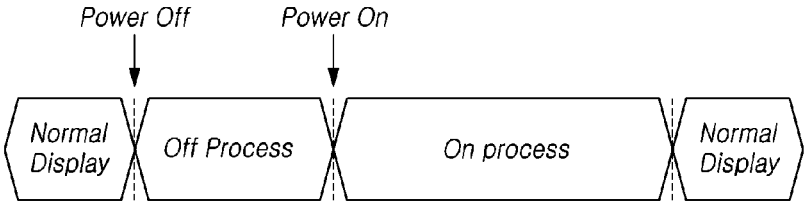
FIG. 4 illustrates a diagram of an on process and an off process in a display device.

FIG. 4 illustrates a diagram of an on process and an off process in a display device.

Referring to FIG. 4, the display device 100 performs a display driving operation Normal Display in which an image is displayed on the display panel 110 by a power on signal Power On, and terminates the operation of the display panel 110 by a power off signal Power Off.

More specifically, when the power off signal Power Off is generated in the process of a display driving operation Normal Display for displaying an image through the display panel 110, the display device 100 performs an off process. During the off process, the input power Vin supplied from the host system 200 may be turned off, and various types of driving power supplied to the display panel 110 from the power management circuit 150 may be individually turned off.

Meanwhile, during a period of off process, the image displayed before the power off signal Power Off is supplied may appear as an afterimage.

In addition, the power on signal Power On may occur in a situation where individual power off operation for various types of voltages is not completed within the off process in response to the power off signal Power Off. As such, when the power on signal Power On occurs within the off process, the display device 100 waits until all of the off process is completed, and performs an on process again when all of the off process is completed.

Accordingly, the display device 100 may perform an on process for the display panel 110 only after a certain time has elapsed from the power off signal Power Off. This time delay may be referred to as an on-time delay.

Recently, a process for detecting and compensating for deviation of a characteristic values (threshold voltage or mobility) of driving transistors DRT in sub-pixels SP of a display panel 110 has been used. Since the compensation process is mainly performed in the off process being performed after the power off signal Power Off is generated or in the on process being performed after the power on signal Power On is generated, it may take more time to drive the display panel 110 again after the power off signal Power Off is supplied.

Accordingly, after the power on signal Power On is generated, there is a problem to take more time in the on process for resetting circuit elements including the timing controller 140, the gate driving circuit 120, and the data driving circuit 130, and for reading a data for the display driving operation.

The display device 100 of the present disclosure may reduce a driving time of the display panel 110 by performing a semi-off process for a predetermined time when the power off signal Power Off is supplied to the display panel 110 and by performing a quick start process when a power on signal Power On is supplied within a period of the semi-off process.

Figure 5:
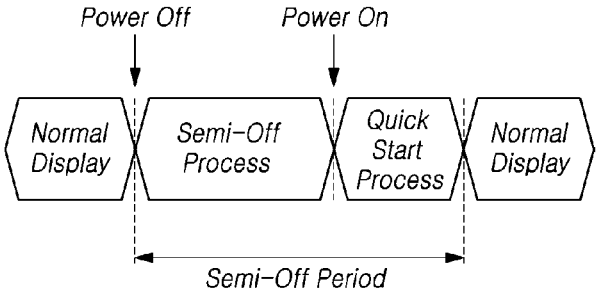
FIG. 5 illustrates that a quick start process is performed when a power on signal is supplied during a semi-off process in a display device according to the present disclosure.

FIG. 5 illustrates a case in which a quick start process is performed when a power on signal is supplied during a semi-off process in a display device according to the present disclosure.

Referring to FIG. 5, the display device 100 according to the present disclosure may perform a semi-off process when a power off signal Power off is supplied during a display driving operation Normal Display in which an image is displayed on the display panel 110.

Unlike the off process, since the input power Vin supplied from the host system 200 is maintained during the semi-off process, various driving power supplied to the display panel 110 by generating at the power management circuit 150 is also normally generated. However, some of the driving power supplied to the display panel 110 may be turned off.

On the other hand, the data voltage Vdata is not supplied to the display panel 110 during a semi-off period in which the semi-off process is performed, since the image data DATA is not transmitted from the host system 200.

The semi-off period in which the semi-off process is performed is a time interval during which a user may turn off the display device 100 and then turn it on again. It may be statistically determined by analyzing a usage pattern of the display device 100 by the users. For example, the semi-off period may be determined to a time interval with several tens of seconds to several minutes from a time point when the power off signal Power Off is supplied.

During the semi-off period in which the semi-off process is performed, the image data DATA from the host system 200 is not transmitted, but various driving power supplied to the display panel 110 may be normally maintained.

Accordingly, when a power on signal Power On is supplied by a user during the semi-off period in which the semi-off process is performed, a quick start process in which image data DATA is transmitted from the host system 200 may be performed maintaining various driving powers supplied to the display panel 110 in an on state.

As such, in the quick start process, the operation of transmitting the image data DATA from the host system 200 is changed maintaining various driving powers supplied to the display panel 110 in an on state. Therefore, it takes a shorter time than the on process for operating both the driving power and the image data DATA.

As a result, it is possible to reduce the time for a display driving operation Normal Display for displaying an image on the display panel 110.

On the other hand, if the semi-off period is terminated in a state the power on signal Power On is not supplied by the user during the semi-off period in which the semi-off process is in progress, the display device 100 may be in off state by blocking various driving powers supplied to the display panel 110 and by cutting off the input power Vin supplied from the host system 200.

On the other hand, the display device 100 of the present disclosure may perform an off-sensing process for sensing a characteristic value (threshold voltage or mobility) of the driving transistor DRT at the time when the semi-off period is terminated.

Figure 6:
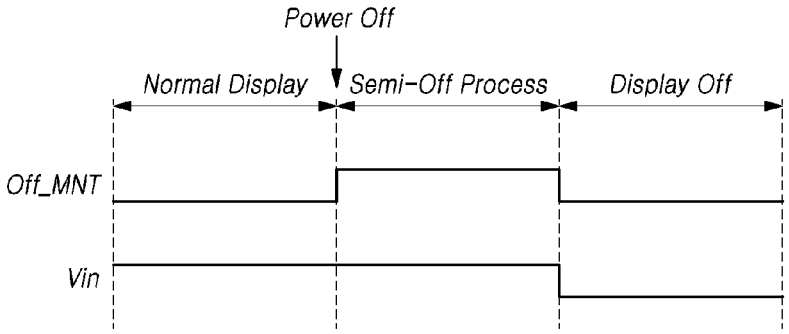
FIG. 6 illustrates a flow chart of signals transmitted from a host system for a display driving method according to the present disclosure.

FIG. 6 illustrates a flow chart of signals transmitted from a host system for a display driving method according to the present disclosure.

Referring to FIG. 6, the display driving method according to aspects of the present disclosure performs a semi-off process when a power-off signal Power Off is supplied by the user. The host system 200 maintains the input power Vin supplied to the display device 100 in a high state during the semi-off period, and supplies an off monitoring signal Off_MNT notifying that the power-off signal Power Off is supplied to the display device 100.

That is, since the input power Vin supplied to the display device 100 from the host system 200 is maintained in a high state during the semi-off period, the display device 100 may supply various driving powers to the gate driving circuit 120 and the data driving circuit 130 as they are during a predetermined time interval after the power off signal Power Off is supplied.

On the other hand, since the off monitoring signal Off_MNT is transmitted from the host system 200 when the power off signal Power Off is supplied, the display device 100 may cut off the data voltage Vdata supplied to the display panel 110 by recognizing that the power off signal Power Off is supplied.

Accordingly, the display device 100 may maintain the driving power supplied to the gate driving circuit 120 and the data driving circuit 130 in an on state, but cut off the data voltage Vdata transmitted to the display panel 110 according to the off monitoring signal Off_MNT transmitted from the host system 200.

As a result, the display device 100 of the present disclosure may perform the quick start process for resuming the display driving operation Normal Display in a short time without the off process by supplying the data voltage Vdata again to the display panel 110 when the power on signal Power On is supplied again from the user during the semi-off period.

At this time, the host system 200 may generate the off monitoring signal Off_MNT at the time when the power off signal Power Off is supplied by the user, and cut off the input power Vin after the semi-off period using a timer therein.

At this time, when the power-on signal is not supplied during the semi-off period, the display device 100 may perform the off-sensing process for sensing characteristic value (threshold voltage or mobility) of the driving transistor DRT and then be a display off state.

Meanwhile, here, it has illustrated an exemplary case that the host system 200 supplies the off monitoring signal Off_MNT and cuts off the input power Vin after the semi-off period when the power off signal Power Off is supplied. However, if there is an internal power source inside the display device 100, the display device 100 may perform the semi-off process by blocking the data voltage Vdata at the time when the power off signal Power Off is supplied, and by maintaining the internal driving powers in an on state during the semi-off period.

Figure 7:
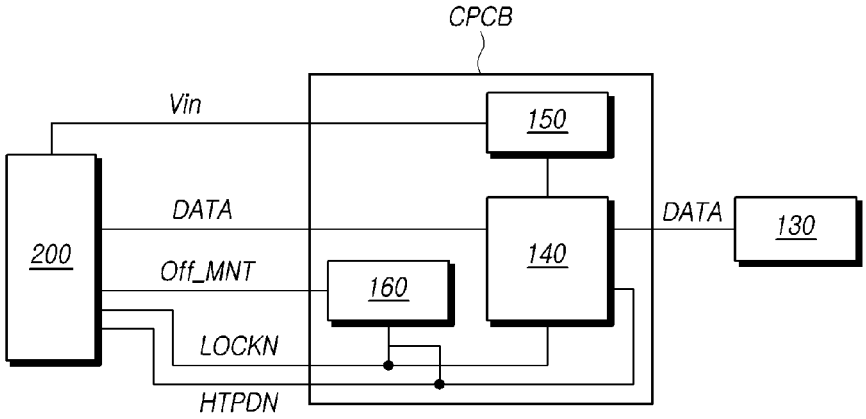
FIG. 7 illustrates a block diagram for a configuration of a display device according to the present disclosure.

FIG. 7 illustrates a block diagram for a configuration of a display device according to the present disclosure.

Referring to FIG. 7, the display device 100 according to aspects of the present disclosure may include a display panel 110, a gate driving circuit 120, a data driving circuit 130, a timing controller 140, a power management circuit 150, and a semi-off switching circuit 160.

A plurality of gate lines GL, a plurality of data lines DL, and a plurality of sub-pixels SP are disposed on the display panel 110. The gate driving circuit 120 supplies the scan signal SCAN to the plurality of gate lines GL. The data driving circuit 130 converts the image data DATA into the data voltage Vdata and supplies it to the plurality of data lines DL.

The power management circuit 150 generates various driving powers for driving the gate driving circuit 120 and the data driving circuit 130 using the input power Vin supplied from the host system 200.

The timing controller 140 controls training and transmission of the image data DATA supplied from the host system 200 using image control signals LOCKN, HTPDN. For example, the host system 200 may supply the image data DATA to the timing controller 140 while the image control signals LOCKN, HTPDN with low level are transmitted from the timing controller 140. Conversely, the host system 200 may block the image data DATA without supplying it to the timing controller 140 when the image control signals LOCKN, HTPDN with high level are transmitted from the timing controller 140. Here, the levels of the image control signals LOCKN, HTPDN for supplying the image data DATA may be variously changed.

The semi-off switching circuit 160 may control the image control signals LOCKN, HTPDN to perform the semi-off process during the semi-off period according to the off monitoring signal Off_MNT of the host system 200.

For example, when a power-off signal Power Off is supplied by a user, the host system 200 may maintain the input power Vin supplied to the display device 100 in a high state during a predetermined semi-off period, and may transmit the off monitoring signal Off MNT indicating the supply of the power off signal Power Off to the display apparatus 100.

As described above, when the off-monitoring signal Off_MNT with a high level is transmitted from the host system 200, the semi-off switching circuit 160 may change the image control signals LOCKN, HTPDN to a high level by supplying a power with a high level to a signal line for transmitting the image control signals LOCKN, HTPDN.

Accordingly, the host system 200 may block the image data DATA while maintaining the input power Vin supplied to the display device 100 in a high state during the semi-off period. As a result, the display device 100 may block the data voltage supplied to the display panel 110 while supplying the driving power to the gate driving circuit 120 and the data driving circuit 130 during the semi-off period.

The semi-off switching circuit 160 may be located inside the timing controller 140 or outside the timing controller 140. When the semi-off switching circuit 160 is located outside the timing controller 140, it may be disposed on the control printed circuit board CPCB. Here, it has illustrated a case that the semi-off switching circuit 160 is disposed on a control printed circuit board CPCB.

Meanwhile, the host system 200 and the display device 100 may be connected by various interfaces.

In this case, the number of interface cables connecting the host system 200 and the control printed circuit board CPCB of the display device 100 may be determined by the amount of data to be transmitted and clock signals.

For example, when the display device 100 is driven with Full-HD 120 Hz, the interface cable between the host system 200 and the control printed circuit board CPCB of the display device 100 requires 48 signal lines in LVDS (low-voltage differential signaling) interface. As such, even if the LVDS interface is applied, the number of signal lines of the interface cable and the number of pins of a connector for connecting the interface cable may increase.

In this case, the cost for an interface cable and connector increases, and a problem of electromagnetic interference (EMI) due to a high-frequency clock signal transmitted through the interface cable may appear.

In order to improve the problem, an interface with less EMI and a smaller number of signal lines comparing the LVDS interface has recently been used. For example, Vbyone interface developed by THine Electronics, Inc has better signal transmission quality than the existing LVDS interface due to the introduction of an equalizer function and has also realized high-speed data processing by maximum 3.75 Gbps per 1 Pair. Further, the Vbyone interface solved the problem of the skew adjustment generated in the clock transmission of the LVDS interface by adopting clock data recovery (CDR). Because the Vbyone interface does not have the clock transmission function required in the existing LVDS interface, an EMI noise resulting from the clock transmission may be reduced.

Because the Vbyone interface may efficiently cope with an increase in an amount of data and the higher speed drive, it is drawing attention as an alternative technology of the existing LVDS interface.

The display device 100 according to aspects of the present disclosure may be connected to the host system 200 through various interfaces, but the case of using the Vbyone interface will be described as an example.

Figure 8:
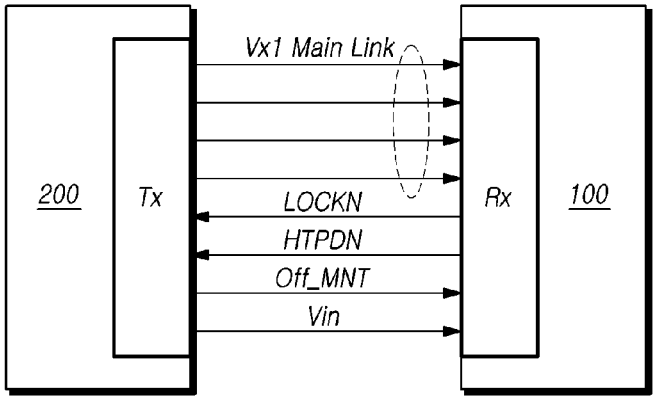
FIG. 8 illustrates a Vbyone interface of a display device according to the present disclosure.
Figure 9:
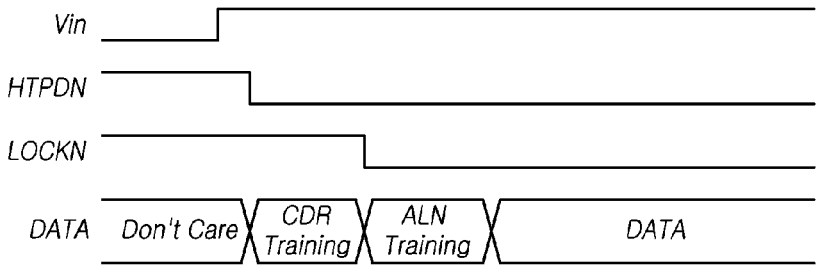
FIG. 9 illustrates a signal flow of a process to transmit image data through the Vbyone interface.

FIG. 8 illustrates a Vbyone interface of a display device according to the present disclosure, and FIG. 9 illustrates a signal flow of a process to transmit image data through the Vbyone interface.

Referring to FIG. 8, the Vbyone interface of the display device 100 according to aspects of the present disclosure may include a transmitter Tx of the host system 200 and a receiver Rx of the display device 100.

In order to transmit image data DATA through the Vbyone interface, a main link Vx1 Main Link for transmitting image data DATA between the host system 200 and the display device 100, and an auxiliary link for transmitting an off monitoring signal Off_MNT and image control signals LOCKN, HTPDN are required. Also, it may include a power link for transmitting the input power Vin to the display device 100.

As described above, the host system 200 may supply the off monitoring signal Off_MNT to the display device 100 at the time when the power off signal Power Off is transmitted by the user, and may cut off the input power Vin after the semi-off period.

Referring to FIG. 9, the display device 100 according to the present disclosure using the Vbyone interface generates an HTPDN signal corresponding to an image control signal at low level after the power on signal Power on is supplied.

The host system 200 transmits a CDR training pattern signal CDR Training to the display device 100 in response to the HTPDN signal with a low level.

The display device 100 includes a CDR circuit for recovering clock. The CDR circuit receives the CDR training pattern signal CDR Training and locks the phase and frequency of the image data DATA.

In a state in which the phase and frequency of the image data DATA are locked, the display device 100 transmits the LOCKN signal at a low level. The host system 200 transmits the image data DATA after transmitting an alignment training pattern signal ALN Training to the display device 100 for a predetermined time in response to the LOCKN signal with a low level.

The alignment training pattern signal ALN Training may include alignment data not displayed on the display panel 110. The alignment data allows the display device 100 to determine the data reception start timing according to a communication protocol of the Vbyone interface. When the alignment data is received, the display device 100 may determine the start timing of the image data DATA to be displayed on the display panel 110.

Figure 10:
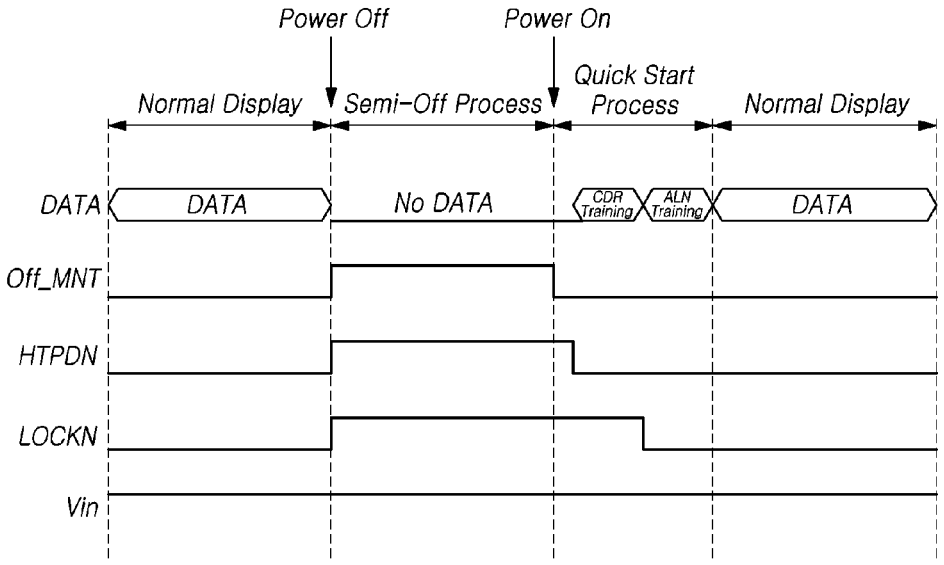
FIG. 10 illustrates a diagram of a signal flow when a power on signal is supplied during a semi-off period in a display driving method according to the present disclosure.

FIG. 10 illustrates a diagram of a signal flow when a power on signal is supplied during a semi-off period in a display driving method according to the present disclosure.

Referring to FIG. 10, the display driving method according to aspects of the present disclosure performs a semi-off process for a semi-off period of a predetermined time when a power off signal Power Off is supplied by the user to the display device 100 within a display driving operation Normal Display for displaying an image through the display panel 110.

For the above operation, the host system 200 maintains the input power Vin transmitted to the display device 100 at high level during the semi-off period from a time when the power off signal is supplied to the display device 100, but supplies the off monitoring signal Off_MNT indicating that the power off signal Power Off has been supplied to the display device 100.

Accordingly, the display device 100 may supply various driving powers to the gate driving circuit 120 and the data driving circuit 130 as they are, since the input power Vin transmitted from the host system 200 to the display device 100 is maintained at a high level during the semi-off period.

On the other hand, the off monitoring signal Off_MNT with a high level may be supplied from the host system 200 when the power off signal Power Off is supplied. Accordingly, the display device 100 recognizes that the power off signal Power Off has been supplied, and converts the image control signals LOCKN, HTPDN for controlling the supply of the image data DATA to a high level. As a result, the host system 200 terminates the supply of the image data DATA to the display device 100. Accordingly, the data voltage Vdata supplied to the display panel 110 in the display device 100 is cut off.

As a result, the display device 100 maintains the driving power supplied to the gate driving circuit 120 and the data driving circuit 130, but cuts off the data voltage Vdata transmitted to the display panel 110 during the semi-off period according to the off monitoring signal Off_MNT transmitted from the host system 200.

The semi-off period may have a time interval of several tens of seconds to several minutes.

If a power on signal Power On is transmitted again by the user during the semi-off period in which the semi-off process is performed, the quick start process may be performed due to an off monitoring signal Off_MNT switched to a low level.

When the quick start process is in progress, the image control signals LOCKN, HTPDN of the display device 100 are sequentially switched to a low level by the off monitoring signal Off_MNT with a low level. That is, when the off-monitoring signal Off_MNT is switched to a low level and the quick start process is performed, the HTPDN signal for CDR training is switched to a low level and then the LOCKN signal for alignment training may be sequentially switched to a low level while the input power Vin is at a high level.

Accordingly, the host system 200 receiving the image control signal LOCKN, HTPDN with a low level transmits the CDR training pattern signal CDR Training and the alignment training pattern signal ALN Training, and restarts the transmission of the image data DATA according to a start timing so that the data voltage Vdata may be supplied to the display panel 110.

As described above, the image data DATA is cut off during the semi-off period from the time when the power off signal Power Off is supplied, but the input power Vin supplied to the display device 100 is maintained in the high level. Therefore, even if the power on signal Power On is supplied again during the semi-off period, the quick start process that resumes the display driving operation Normal Display quickly without going through an off process may be performed.

Figure 11:
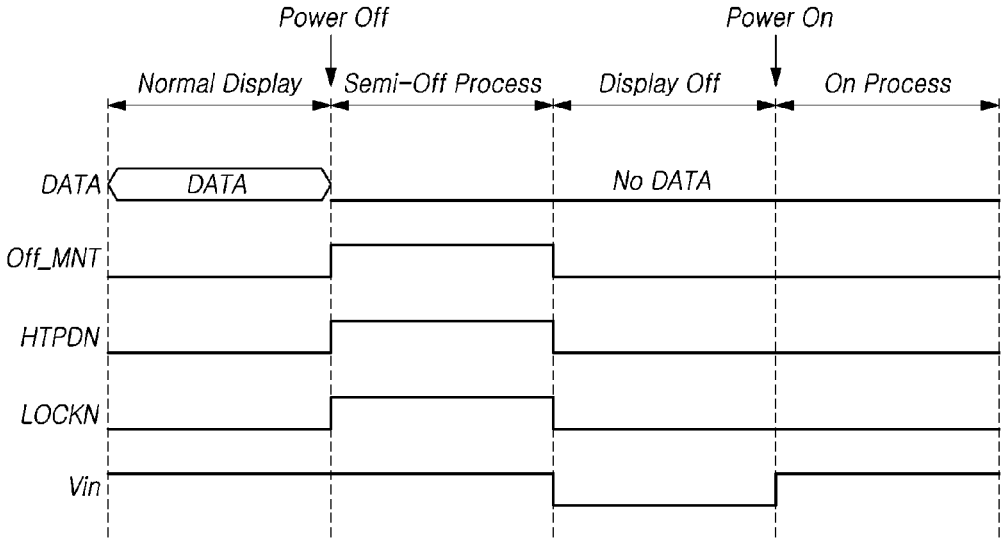
FIG. 11 illustrates a signal flow when a power-on signal is not supplied during a semi-off period in a display driving method according to the present disclosure.

FIG. 11 illustrates a signal flow when a power-on signal is not supplied during a semi-off period in a display driving method according to the present disclosure.

Referring to FIG. 11, the display driving method according to the aspects of the present disclosure performs a semi-off process for a semi-off period of a predetermined time when a power off signal Power Off is supplied by the user within the display driving operation Normal Display for displaying an image through the display panel 110 in the display device 100.

The host system 200 maintains the input power Vin transmitted to the display device 100 at high level during the semi-off period from a time when the power off signal is supplied to the display device 100, but supplies the off monitoring signal Off_MNT indicating that the power off signal Power Off has been supplied to the display device 100.

Accordingly, the display device 100 may supply various driving powers to the gate driving circuit 120 and the data driving circuit 130 as they are, since the input power Vin transmitted from the host system 200 to the display device 100 is maintained at a high level during the semi-off period.

On the other hand, the off monitoring signal Off_MNT with a high level may be supplied from the host system 200 when the power off signal Power Off is supplied. Accordingly, the display device 100 recognizes that the power off signal Power Off has been supplied, and converts the image control signals LOCKN, HTPDN for controlling the supply of the image data DATA to a high level. As a result, the host system 200 terminates the supply of the image data DATA to the display device 100.

If a power on signal Power On is not supplied again by the user during the semi-off period in which the semi-off process is in progress, the input power Vin supplied from the host system 200 is cut off at the time when the semi-off period is terminated.

When the input power Vin supplied from the host system 200 is cut off, the gate driving circuit 120 and the data driving circuit 130 of the display device 100 terminate operations, so that the display panel 110 is in a display off state Display Off.

As such, the input power Vin is cut off and the display device 100 is turned off when the semi-off period terminates, so the image control signals LOCKN, HTPDN are cut off regardless of the off monitoring signal Off_MNT is at a high level or low level.

At this time, the off-sensing process for sensing the characteristic value (threshold voltage or mobility) of the driving transistor DRT at the end of the semi-off period may be performed.

If the power on signal Power On is supplied by the user after the display device 100 is turned off, the display device 100 may perform an on process according to a predetermined sequence.

Figure 12:
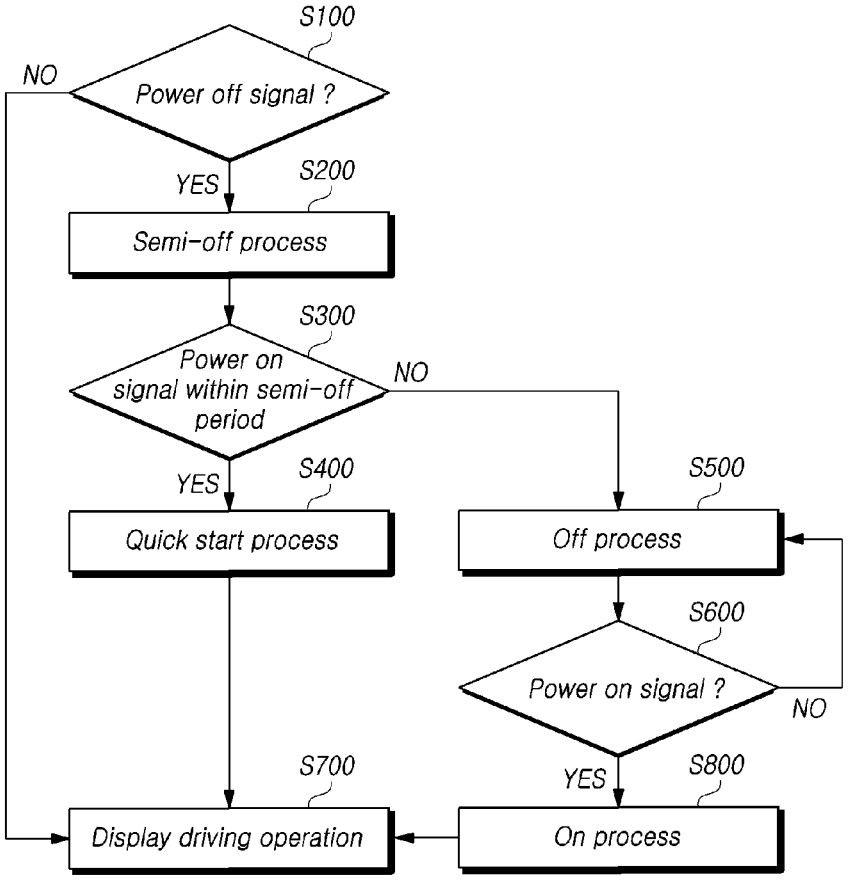
FIG. 12 illustrates a flowchart of a display driving method according to aspects of the present disclosure.

FIG. 12 illustrates a flowchart of a display driving method according to the present disclosure.

Referring to FIG. 12, the display driving method according to aspects of the present disclosure may include a step S100 of determining whether a power off signal Power Off is supplied, a step S200 of performing a semi-off process for blocking the image data while maintaining a driving power when the power off signal Power Off is supplied, a step S300, S400 of performing a quick start process when a power on signal Power On is supplied within the semi-off period, and a step S500 of performing an off process for cutting off the driving power when the power on signal Power On is not supplied within the semi-off period.

When the quick start process is completed, normal display driving operation may be performed S700. And, when the power on signal Power On is supplied within the display off state, normal display driving operation may be performed through the on process S800.

A brief description of the aspects of the present disclosure described above is as follows.

The display device 100 according to aspects of the present disclosure may include a display panel 110 on which a plurality of sub-pixels SP are disposed, a timing controller 140 configured to transmit an image control signal LOCKN, HTPDN to a host system 200 to receive image data DATA from the host system 200, a data driving circuit 130 configured to convert the image data DATA transmitted from the timing controller 140 into a data voltage Vdata and configured to supply the data voltage Vdata to the display panel 110, and a semi-off switching circuit 160 configured to control the image control signal LOCKN, HTPDN so that the image data DATA is cut off from the host system 200 during a semi-off period of a predetermined time from a time when an off monitoring signal Off_MNT is transmitted from the host system 200 in response to the power off signal Power Off.

The host system 200 is configured to cut off an input power after the off monitoring signal Off_MNT is transmitted and a semi-off period is terminated.

A driving power supplied to the data driving circuit 130 is maintained in an on state during the semi-off period.

The semi-off switching circuit 160 is configured to control the image control signal LOCKN, HTPDN so that the image data DATA is supplied from the host system 200 when a power on signal Power On is supplied during the semi-off period.

A driving power supplied to the data driving circuit 130 is turned to an off state when a power on signal Power On is not supplied during the semi-off period.

An off-sensing process for sensing a characteristic value of a driving transistor DRT disposed on the display panel 110 is performed at the end of the semi-off period.

A Vbyone interface is used for communication with the host system 200.

The image control signal LOCKN, HTPDN includes an HTPDN signal for the host system 200 to transmit a CDR training pattern signal CDR Training for a predetermined time, and a LOCKN signal for the host system 200 to transmit an alignment training pattern signal for a predetermined time.

The semi-off period is a time interval of several tens of seconds to several minutes.

In addition, a display driving method according to aspects of the present disclosure for controlling a display device 100 including a display panel 110 on which a plurality of sub-pixels SP are disposed, a timing controller 140 configured to control an operation of a host system 200 supplying an image data DATA by an image control signal LOCKN, HTPDN, and a data driving circuit 130 configured to convert the image data DATA transmitted from the timing controller 140 into a data voltage Vdata and supply the data voltage Vdata to the display panel 110 may include determining whether a power off signal Power Off is supplied, performing a semi-off process for blocking the image data DATA while maintaining a driving power supplied to the data driving circuit 130 when the power off signal Power Off is supplied, performing a quick start process when a power on signal Power On is supplied within the semi-off period, and cutting off the driving power when the power on signal Power On is not supplied within the semi-off period.

The semi-off process includes an operation of controlling the image control signal LOCKN, HTPDN so that the image data DATA is cut off from the host system 200 during the semi-off period from a time when an off monitoring signal Off MNT is transmitted from the host system 200 in response to the power off signal Power Off.

The quick start process includes an operation of controlling the image control signal LOCKN, HTPDN so that the image data DATA is supplied from the host system 200.

In addition, a display device 100 according to aspects of the present disclosure may include a display panel 110 on which a plurality of sub-pixels SP are disposed, a timing controller 140 configured to transmit an image control signal LOCKN, HTPDN to a host system 200 to receive image data DATA from the host system 200, a data driving circuit 130 configured to convert the image data DATA transmitted from the timing controller 140 into a data voltage Vdata and configured to supply the data voltage Vdata to the display panel 110, and a semi-off switching circuit 160 configured to control the timing controller 140 to perform a semi-off process for cutting off the image data DATA while maintaining a driving power supplied to the data driving circuit 130 during a semi-off period when an off-monitoring signal Off_MNT indicating a supply of a power off signal Power Off is received from the host system 200, and to perform a quick start process for supplying the image data DATA when a power on signal Power On is supplied within the semi-off period.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the aspects disclosed in the present disclosure are intended to illustrate the scope of the technical idea of the present disclosure, and the scope of the present disclosure is not limited by the aspect. The scope of the present disclosure shall be construed on the basis of the accompanying claims in such a manner that all of the technical ideas included within the scope equivalent to the claims belong to the present disclosure.

What is claimed is:

1. A display device comprising:

a display panel on which a plurality of sub-pixels are disposed;

a timing controller configured to transmit an image control signal to a host system to receive image data from the host system;

a data driving circuit configured to convert the image data transmitted from the timing controller into a data voltage and configured to supply the data voltage to the display panel; and a semi-off switching circuit configured to control the image control signal so that the image data is cut off from the host system during a semi-off period of a first predetermined time from a time when an off monitoring signal is transmitted from the host system in response to a power off signal.

2. The display device according to claim 1, wherein the host system is configured to cut off an input power supplied for a display driving operation after the off monitoring signal is transmitted and a semi-off period is terminated.

3. The display device according to claim 1, wherein a driving power supplied to the data driving circuit is maintained in an on state during the semi-off period.

4. The display device according to claim 1, wherein the semi-off switching circuit is configured to control the image control signal so that the image data is supplied from the host system when a power on signal is supplied during the semi-off period.

5. The display device according to claim 1, wherein a driving power supplied to the data driving circuit is turned to an off state when a power on signal is not supplied during the semi-off period.

6. The display device according to claim 1, wherein an off-sensing process for sensing a characteristic value of a driving transistor disposed on the display panel is performed at an end of the semi-off period.

7. The display device according to claim 1, further comprising a Vbyone interface for communicating with the host system.

8. The display device according to claim 7, wherein the image control signal includes:

an HTPDN signal for the host system to transmit a CDR training pattern signal for a second predetermined time; and a LOCKN signal for the host system to transmit an alignment training pattern signal for a third predetermined time.

9. The display device according to claim 1, wherein the semi-off period is a time interval of several tens of seconds to several minutes.

10. A display driving method for controlling a display device including a display panel on which a plurality of sub-pixels are disposed, a timing controller configured to control an operation of a host system supplying an image data by an image control signal, and a data driving circuit configured to convert the image data transmitted from the timing controller into a data voltage and supply the data voltage to the display panel, comprising:

determining whether a power off signal is supplied;

performing a semi-off process for blocking the image data while maintaining a driving power supplied to the data driving circuit when the power off signal is supplied;

performing a quick start process when a power on signal is supplied within a semi-off period; and cutting off the driving power when the power on signal is not supplied within the semi-off period.

11. The display driving method according to claim 10, wherein the semi-off process includes an operation of controlling the image control signal so that the image data is cut off from the host system during the semi-off period from a time when an off monitoring signal is transmitted from the host system in response to the power off signal.

12. The display driving method according to claim 10, wherein the quick start process includes an operation of controlling the image control signal so that the image data is supplied from the host system.

13. The display driving method according to claim 12, further comprising a Vbyone interface for communicating with the host system.

14. The display driving method according to claim 13, wherein the image control signal includes:

an HTPDN signal for the host system to transmit a CDR training pattern signal for a second predetermined time; and a LOCKN signal for the host system to transmit an alignment training pattern signal for a third predetermined time.

15. The display driving method according to claim 10, further comprising performing an off-sensing process for sensing a characteristic value of a driving transistor disposed on the display panel at the end of the semi-off period.

16. The display driving method according to claim 10, wherein the semi-off period is a time interval of several tens of seconds to several minutes.

17. A display device comprising:

a display panel on which a plurality of sub-pixels are disposed;

a timing controller configured to transmit an image control signal to a host system to receive image data from the host system;

a data driving circuit configured to convert the image data transmitted from the timing controller into a data voltage and configured to supply the data voltage to the display panel; and a semi-off switching circuit configured to control the timing controller to perform a semi-off process for cutting off the image data while maintaining a driving power supplied to the data driving circuit during a semi-off period when an off-monitoring signal indicating a supply of a power off signal is received from the host system, and to perform a quick start process for supplying the image data when a power on signal is supplied within the semi-off period.

* * * * *